US006320133B1

(12) United States Patent
Rimmer

(10) Patent No.: US 6,320,133 B1
(45) **Date of Patent: *Nov. 20, 2001**

(54) POWER DISTRIBUTION SYSTEM

(75) Inventor: John Philip Rimmer, London (GB)

(73) Assignee: Tunewell Technology LTD, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/284,331

(22) PCT Filed: Oct. 10, 1997

(86) PCT No.: PCT/GB97/02799

§ 371 Date: Jun. 25, 1999

§ 102(e) Date: Jun. 25, 1999

(87) PCT Pub. No.: WO98/17085

PCT Pub. Date: Apr. 23, 1998

(30) Foreign Application Priority Data

Oct. 11, 1996 (GB) ..... 9621353

(51) Int. Cl.[7] ..... H01B 17/16
(52) U.S. Cl. ..... 174/117 F; 174/117 FF
(58) Field of Search ..... 174/117 FF, 117 F, 174/36, 250; 439/492

(56) References Cited

U.S. PATENT DOCUMENTS

| | | | | |
|---|---|---|---|---|
| 2,060,913 | | 11/1936 | Weaver | 173/367 |
| 3,440,336 | * | 4/1969 | Bogner | 174/128 |
| 3,573,676 | | 4/1971 | Ferdy | 333/79 |
| 3,671,675 | | 6/1972 | Ress | 179/15 FD |
| 3,973,227 | * | 8/1976 | Erculiani | 333/97 R |
| 4,109,307 | | 8/1978 | Knoll | 363/101 |
| 4,204,273 | * | 5/1980 | Goldberg | 362/217 |
| 4,301,428 | * | 11/1981 | Mayer | 333/12 |
| 4,329,539 | * | 5/1982 | Tanaka et al. | 174/128 S |
| 4,540,224 | | 9/1985 | Marcos | 339/14 R |
| 4,651,059 | * | 3/1987 | Nilssen | 315/182 |
| 4,652,772 | * | 3/1987 | Shephard | 307/147 |
| 4,694,123 | * | 9/1987 | Massey | 174/117 FF |
| 4,717,357 | * | 1/1988 | Greenwood | 439/492 |
| 4,845,311 | * | 7/1989 | Schreiber et al. | 174/36 |
| 4,864,081 | * | 9/1989 | Bates | 174/88 R |

(List continued on next page.)

FOREIGN PATENT DOCUMENTS

| | | |
|---|---|---|
| 0 209 826 | 1/1987 | (EP) . |
| 0 407 167 A2 | 7/1990 | (EP) . |
| 0 397 080 | 11/1990 | (EP) . |
| 2 012 097 | 7/1979 | (GB) . |
| 2 274 946 | 10/1994 | (GB) . |
| 58 143509 | 8/1983 | (JP) . |
| 63038541 | 8/1989 | (JP) . |

OTHER PUBLICATIONS

Patent Abstracts of Japan, vol. 007, No. 258, Nov. 17, 1983.

*Primary Examiner*—Dean A. Reichard
*Assistant Examiner*—William H. Mayo, III
(74) *Attorney, Agent, or Firm*—Armstrong, Westerman, Hattori, McLeland & Naughton, LLP

(57) ABSTRACT

A power distribution system to distribute electric power having a source of alternating current of a frequency of 10 kHz or greater, a distribution line connected to the source, and at least one load. The distribution line has two substantially flat conductors separated by an insulating sheet, and an element formed of a material of high relative permeability associated with at least one of the conductors. With use of the system an electronic ballast can be used with dichroic and discharge lamps, with high efficiency and absence of light flicker. Substantial reduction in H field interference due to the high frequency alternating current is achieved with use of the distribution line.

13 Claims, 2 Drawing Sheets

U.S. PATENT DOCUMENTS

| | | | | |
|---|---|---|---|---|
| 4,894,124 | | 1/1990 | Walsh et al. | 204/30 |
| 5,003,227 | | 3/1991 | Nilssen | 315/161 |
| 5,172,310 | | 12/1992 | Deam et al. | 363/144 |
| 5,393,933 | * | 2/1995 | Goetz | 174/117 R |
| 5,510,974 | | 4/1996 | Gu et al. | 363/134 |
| 5,801,124 | * | 9/1998 | Gamble et al. | 505/230 |
| 5,804,768 | * | 9/1998 | Sexton | 174/117 F |
| 5,847,324 | * | 12/1998 | Farquhar et al. | 174/117 F |
| 5,932,523 | * | 8/1999 | Fujikami et al. | 505/231 |
| 6,005,193 | * | 12/1999 | Markel | 174/117 FF |
| 6,218,622 | | 4/2001 | Rimmer | 174/117 |

* cited by examiner

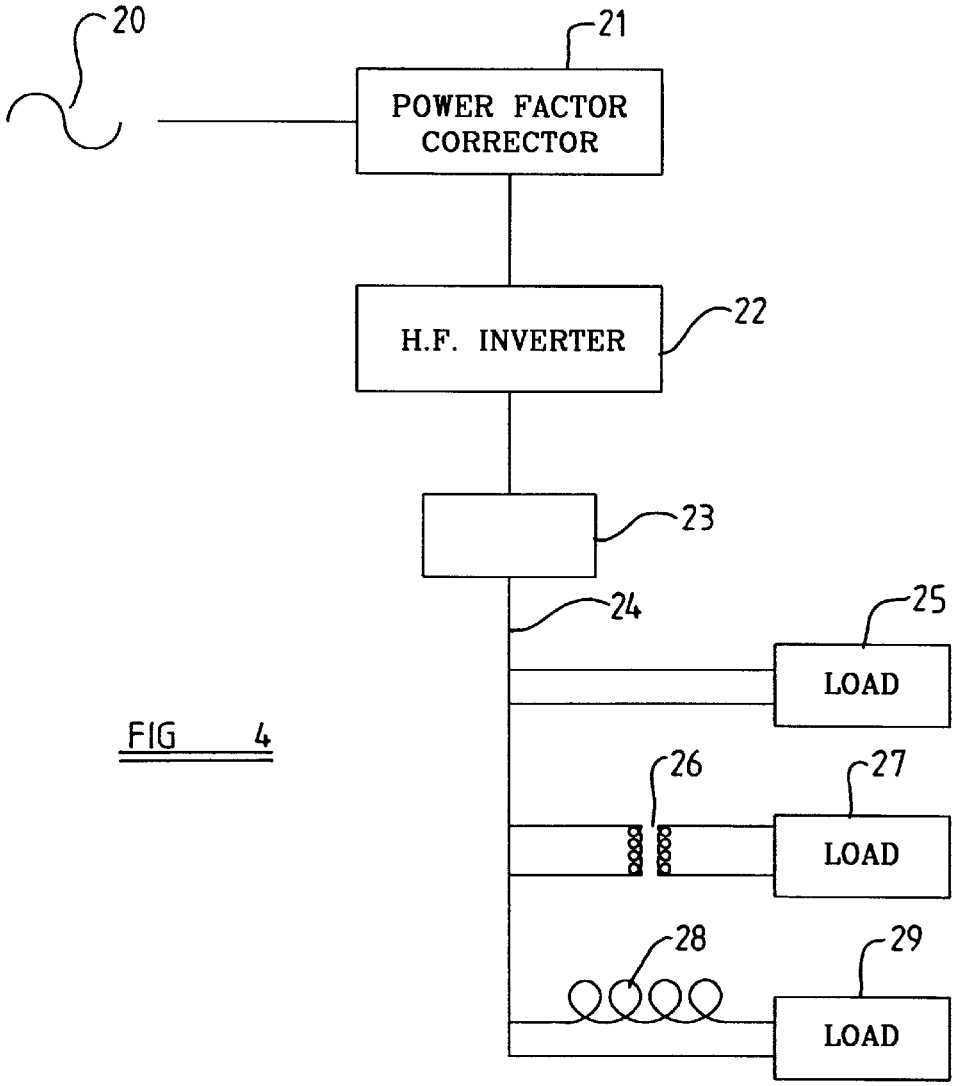
FIG 4
FIG 5
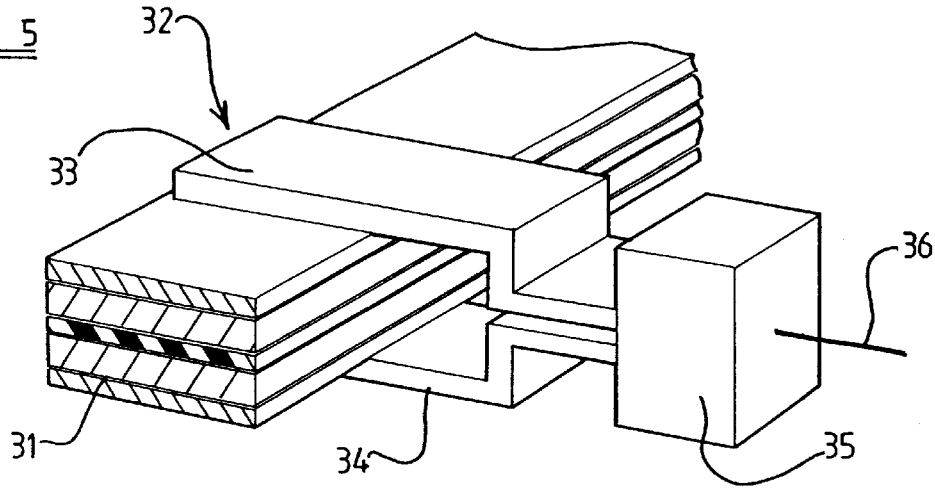

POWER DISTRIBUTION SYSTEM

BACKGROUND OF THE INVENTION

1. Field of the Invention

The present invention relates to a power distribution system and more particularly relates to a power distribution system adapted to distribute electric power from a power source to at least one load.

2. Description of Related Art

Various power distribution systems have been used to distribute power from a power source to a load. The power may be distributed at a typical "mains" voltage of 240 volts (or, in some countries 110 volts) and at a typical "mains" frequency of 50 cycles per second (in some countries, 60 cycles per second). A disadvantage of this type of distribution system is that since a relatively low voltage is used, for a moderate power supply, a substantial current flows, meaning that the conductors must be capable of carrying a substantial current. Consequently, the cables typically include conductors formed of copper, the conductors having a relatively large cross-section.

If a distribution system of this type is utilized with a discharge lamp, for example, a step-up transformer has to be utilized. Since the frequency of the alternating current is relatively low, the transformer must be relatively bulky.

There is a desire to be able to utilize, in connection with dichroic lamps and discharge lamps, an electronic ballast. An electronic ballast is small and light and also, in connection with a discharge lamp, provides high efficiency and a light that is substantially flicker-free. However, to be able to utilize an electronic ballast, there is a need for a high frequency alternating current. In many states, local legislation insists that where an electronic ballast is utilized, a power factor connector must be provided to ensure that the power factor "seen" at the main supply is appropriate. A problem exists in connection with a high frequency power distribution system in that substantial H field "interference" can be generated.

SUMMARY OF THE INVENTION

The present invention seeks to provide an improved power distribution system.

According to this invention there is provided an electric power distribution arrangement comprising a source of alternating current having a frequency of 10 kHz or greater, and a distribution line connected to said source. The distribution line comprises three layers constituted by: two conductors, each of substantially flat configuration, the conductors being located in spaced parallelism and being located a short distance apart; and, an insulator that separates the two conductors At least one of the conductors, included in the three layers of the transmission line, being associated with a respective further element formed of a material of high relative permeability. That further element comprising a foil secured to the face of the conductor, remote from the insulator. The arrangement further comprises at least one load connected to said conductors to receive electric power therefrom.

In one embodiment the load is connected directly to the two conductors. In another embodiment the load is connected to the conductors by means of a transformer, the transformer having a primary winding connected to the two conductors, and having a secondary winding connected to the load. It is conceivable that the load comprises a low voltage incandescent lamp, but preferably the load comprises a discharge lamp, an impedance being provided which is connected in circuit with the secondary winding and the discharge lamp.

In another embodiment each load comprises a discharge lamp connected to one conductor of the distribution line by means of an inductance, and connected directly to the other conductor of the distribution line.

Preferably the source of alternating current comprises a power factor corrector, which receives supply from a mains electricity supply, and an inverter which receives power from the power factor corrector.

Conveniently the power factor corrector comprises a rectifier producing a DC output, the DC output of the power factor corrector being provided as an input to the inverter.

Advantageously a transformer is provided located between the source of the high frequency current and the distribution line.

Advantageously a second element of high permeability is provided associated with the other conductor.

Conveniently each element of high relative permeability extends laterally beyond the associated flat conductor.

Preferably each element of high permeability is formed of an amorphous or nano-crystalline metal.

Conveniently each conductor is of flat cross-section, with two opposed parallel flat faces. The insulator separating the conductors comprising a sheet of insulating material.

Advantageously the foil is separated from the face of the conductor to which it is secured by means of an insulating layer.

BRIEF DESCRIPTION OF THE DRAWINGS

In order that the invention may be more readily understood, and so that further features thereof may be appreciated, the invention will now be described, by way of example, with reference to the accompanying drawings in which:

FIG. 4 is a block diagram illustrating a power distribution arrangement in accordance with the invention, and FIG. 5 is a view illustrating the transmission line and a connecting clip.

DETAILED DESCRIPTION OF THE INVENTION

Figure 1:
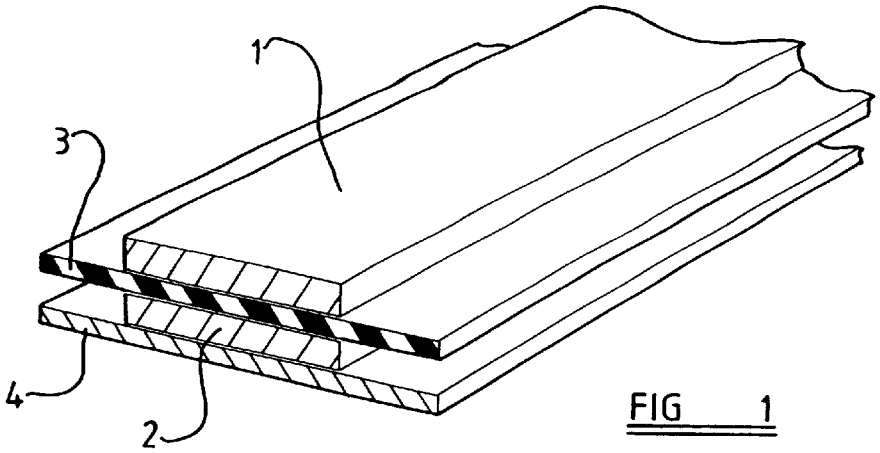
FIG. 1 is a view of a power transmission line suitable for use in a power distribution system in accordance with the invention, with parts thereof cut away for the sake of clarity of illustration.

Referring initially to FIG. 1 of the accompanying drawings, a power transmission line is illustrated which is suitable for use in transmitting power of a voltage between, for example, 150 volts and 1 kv, at an operating frequency of greater than 10 kHz, most preferably at a frequency of 60 kHz. The power transmission line comprises two principal conductors 1, 2. Each of the conductors is of substantially flat or rectangular cross-section, with two opposed parallel flat faces. The conductors may be formed of copper or copper alloy and may have a thickness of between 0.025 and 0.25 mm, and a width of up to 30 mm, depending upon the current to be carried.

The two conductors are separated by a sheet of insulating material 3. The insulating material may be an appropriate plastic such as a polyester, polypropylene or polyphenylene sulphide. The thickness of the insulating sheet 3 depends upon the voltage to be carried by the conductors 1 and 2 and may typically be of the order of 0.1 millimeters.

It is to be observed that the insulating sheet 3, in the embodiment illustrated in FIG. 1, has such a width that it extends beyond the conductors 1 and 2.

Although a suitable transmission line may comprise simply the three layers described above, in this embodiment a foil 4 is associated with the conductor 2. The foil 4 is made of a material having a high relative permeability. Typically the relative permeability of the foil may be of the order of $10^5$. The foil 4 is secured to the face of the conductive element 2 which is remote from the insulating layer 3. The foil 4 has a width which is greater than the width of the conductive element 2, so that parts of the foil project beyond the conductive element 2 on each side thereof.

The foil 4 may be formed from an amorphous or nanocrystalline metal, such as steel or a cobalt/steel alloy. Such a metal has a high resistivity.

Typically, a foil of high permeability of this type may be created by quench cooling molten metal at a very high speed, for example, at a speed of $10^6$ degrees celsius per second. The molten metal may be sprayed onto a cooled, rapidly rotating drum. The metal cools on the drum and may be removed from the drum in the form of a strip.

It has been found that the foil 4, or high relative permeability, constitutes a low reluctance path for magnetic field and, when a distribution line, as illustrated in FIG. 1 is utilized, on the side of the transmission line where the foil is provided there is a 100 fold reduction in the flux that causes radio frequency interference as compared with an equivalent transmission line without a foil of relatively high permeability. On the other side of the transmission line there is a ten fold reduction in the flux compared with an equivalent transmission line without a foil of relatively high permeability.

The embodiment of FIG. 1 may be altered by providing a second foil corresponding to the foil 4, the second foil being secured to the exposed faced of conductor 1.

Figure 2:
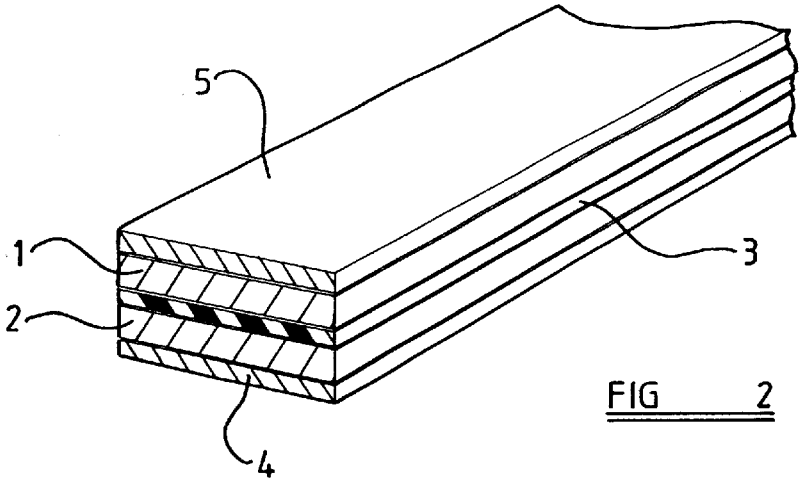
FIG. 2 is a view corresponding to FIG. 1 illustrating a second power line for use in the invention.

FIG. 2 illustrates a second embodiment of the invention in which the conductors 1 and 2 are as described above, with the insulating layer 3 being of the same width as that of the conductors 1 and 2. In this embodiment, a foil 4 of high permeability material is provided in contact with the conductor 2, but has the same width as the width of the conductor 2. A second foil 5, of high permeability material, which corresponds directly with foil 4, is connected to the conductor 1.

It is found that by providing a foil of high relative permeability adjacent each of the conductors 1 and 2, the flux that generates radio frequency interference signal is reduced, on each side of the distribution line, by a factor of approximately 1,000. In the embodiment of FIG. 2 the foils have the same width as the width of the conductors. This provides a transmission line which is easy to handle, and which, if desired, may be easily provided with an insulating sheath. However, because the foils 4 and 5 do not extend beyond the conductors, the shielding effect provided by the foils 4 and 5 is not as great as it would be if the foils 4 and 5 were wider than the conductors 1, 2.

Figure 3:
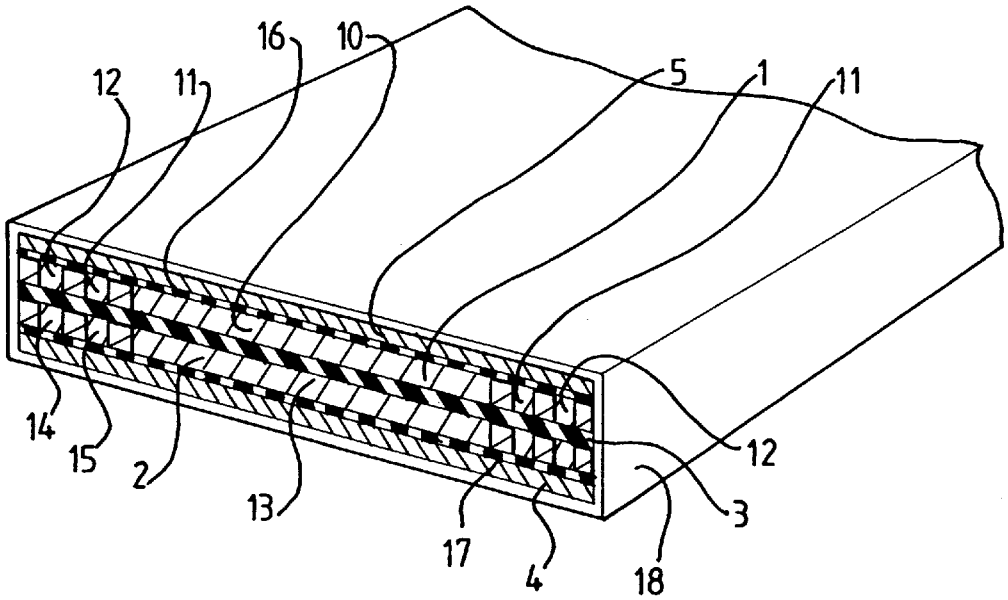
FIG. 3 is a view of a power transmission line for incorporating into the circuit of a power generator in accordance with the invention.

FIG. 3 illustrates a further embodiment of a transmission line. In this embodiment of the invention, the copper conductor 1 is provided as a central core region 10 which extends axially of the transmission line and, on either side thereof, two further spaced apart regions 11, 12, extend in parallelism with the core region 10. Similarly the conductor 2 comprises a central core region 13 and, on either side, two further spaced apart regions 14, 15. The conductors 1 and 2 are separated by an insulating layer 3. The conductor 1 is separated from a foil 5 of high permeability by a thin insulating layer 16. Likewise, the conductor 2 is separated from the foil 4 by means of a thin insulating layer 17. The spaces between the various parts of each conductor 1 and 2 may be filled with an adhesive such as an acrylic adhesive.

The entire arrangement, as so far described, is covered by an outer sleeve 18 of an appropriate insulating material, such as a plastic material.

It is to be appreciated that in the transmission line of FIG. 3, the layers of foil of high permeability material are separated from the conductive layers, with which they are associated, by means of a respective thin layer of an insulating material.

It is to be appreciated that in the transmission line of FIG. 3, each conductive layer is formed of a central core and further components which extend parallel with that core but spaced therefrom. The provision of an arrangement of this type has been found to reduce eddy-currents which might otherwise occur at the edge of a relatively large flat conductive core. The provision of an adhesive between the various components of the conductive element help ensure that the various layers that form the laminate, that constitutes the distribution line illustrated in FIG. 3, remain in a predetermined position relative to each other.

It has been found that distribution lines of the type described above provide very low inductance, low resistance and high capacitance. The capacitance provided by the distribution line can be incorporated into the circuit of a power generator which is utilized to supply power through the distribution line, for example as part of a resonating circuit.

It is preferred to use an appropriate insulating material for the insulating sheet 3 between the conductors 1 and 2 so that the capacitance is of a high quality, that is to say with a low power loss. The polyester material mentioned above provides good characteristics and is suitable for use at a low to medium temperature. Polypropylene provides better characteristics, but is only suitable for use at low temperatures. Polyphenylene Sulphide provides good properties, and is suitable for use at high to medium temperatures.

Referring now to FIG. 4 of the accompanying drawings, a power distribution arrangement in accordance with the invention is illustrated.

Referring to FIG. 4, a mains supply 20 is connected to a power factor corrector 21. The power factor corrector is intended to ensure that the power factor of the current drawn by the load is appropriate. In this embodiment of the invention the power factor corrector is a rectifier which produces a 340 volt DC output.

The output of the power factor corrector 21 is provided to a high frequency inverter 22. The output of the high frequency inverter 22 is typically 10 kHz or greater. The preferred frequency is 60 kHz. The output of the inverter 22 is connected to a transformer 23 which must be considered to be "optional". The transformer 23 may provide an isolating function, separating, electrically, the components now to be described, from the components described above. The transformed may step the output voltage, provided by the inverter 22, either up or down, as is desired.

The output of the transformer 23 is connected to a transmission line 24. The transmission line 24 may have the form as illustrated, for example, in FIG. 1, FIG. 2 or FIG. 3 and as described above.

The two conductors 1, 2 of the power distribution line 24 may be connected, as illustrated, directly to a load 25. The load 25 may comprise an appropriate incandescent lamp, or could comprise a heater or some other equivalent device.

A transformed 26 may have a primary winding connected to the two conductors of the distribution line 24. The secondary winding of the transformer may be connected to a load 27. Because the alternating current present on the distribution line 24 has a high frequency, in excess of 10 kHz, the transformer need physically only be very small. The load may comprise, for example, a 12 volt dichroic incandescent lamp or, alternatively, a discharge lamp. Of course, in the case of a discharge lamp, an appropriate impedance, such as an inductance will need to be incorporated within the circuit to act as a ballast.

Alternatively, one conductor of the distribution line 24 may be connected by means of an inductor 28 to a load 29, the other conductor, in the distribution line 24, being connected directly to the load. The load may comprise a discharge lamp. The inductor 28 provides an appropriate ballasting effect.

While only one load connection of each of the three types discussed above is provided, it is to be understood that a power distribution arrangement in accordance with the invention may supply power to a large number of loads.

FIG. 5 illustrates a transmission line 3 of the types shown in FIG. 2. A clip 32 is provided which has two spaced apart blades 33, 34, which engages the opposed faces of the transmission line. Although the high permeability foils 4 and 5 are amorphous and thus have a high resistance, nevertheless, since the blades 33, 34 of the clip 32 engage a substantial area of the foils 4 and 5, the arms of the clip may provide an appropriate power-take-off. The arms of the clip may be connected to, for example, a housing 35 which contains an appropriate transformer for an item which is to be supplied with electrical power. Thus, a clip as shown may establish the connection between a load and a distribution line.

In an arrangement as described, the electric power is distributed at a high frequency. Problems that might arise, in connection with the use of a high frequency distribution system, as a consequence of "interference", are overcome by use of the specific transmission line which incorporates two substantially flat conductors which are located in spaced parallelism, very close to each other, and which are separated by an appropriate insulator. The problem of interference may be reduced further by providing the high permeability material mentioned above.

The power may be distributed at a moderate voltage, for example, 300–340 RMS, or 150–170 RMS or approximately 85 RMS. If the power is distributed at a moderate voltage, and needs to be transformed to a lower or higher voltage at the point of utilization, only a physically small transformer need be utilized, because of the high frequency.

It has been found that in utilizing a preferred embodiment of the invention, it is possible to connect a mains supply 20, through an appropriate power factor corrector 21, to a high frequency distribution system with a plurality of lamps being connected to the distribution system and each lamp being associated with its own electronic ballast. Because the lamps are provided with high frequency alternating current, ballasts need only be small and light. If the lamps are discharge lamps, it is possible to obtain high efficiency and substantially flicker-free-light. The power factor corrector satisfies the appropriate legislation, and because a distribution line of the type described with reference to FIG. 1, 2 or 3 is utilized, there is virtually no H-field interference If the voltage present on the two conductors of the distribution line is always equal and opposite, about earth, that is to say if the two conductors of the distribution line are provide with an alternating voltage in anti-phase about earth, then only a very small electric field, E, is generated.

In the described embodiment, a main supply is connected through a power factor corrector to a high frequency inverter to generate the initial high frequency. However, in alternative embodiments of the invention , the high frequency may be generated directly from the mains using an appropriate frequency generator.

What is claimed is:

1. An electric power distribution arrangement comprising a source of alternating current having a frequency of 10 kHz or greater, a distribution line connected to said source, the distribution line comprising three layers constituted by two conductors, each of substantially flat configuration with two opposed parallel faces and lying in separate planes, a first of said conductors lying in one plane and a second of said conductors lying in another separate plane in spaced parallelism with said first conductor, the conductors being located in spaced parallelism relative to the parallel faces and being located a short distance apart, and an insulator that separates the two conductors disposed between the two opposed parallel faces of the two conductors of substantially flat configuration, at least one of the conductors included in the three layers of the transmission line being associated with a respective further element formed of a material of high relative permeability, that element comprising a foil secured to a face of the at least one conductor remote from the insulator, the arrangement further comprising at least one load connected to said conductors to receive electric power therefrom.

2. An arrangement according to claim 1 wherein the at least one load is connected directly to the two conductors.

3. An arrangement according to claim 1 wherein the at least one load is connected to the conductors by means of a transformer, the transformer having a primary winding connected to the two conductors, and having a secondary winding connected to the at least one load.

4. An arrangement according to claim 3 wherein the at least one load comprises a discharge lamp, an impedance being provided which is connected in circuit with the secondary winding and the discharge lamp.

5. An arrangement according to claim 1 wherein the at least one load comprises a low voltage incandescent lamp.

6. An arrangement according to claim 1 wherein the at least one load comprises a discharge lamp connected to one of the conductors of the distribution line by means of an inductance and connected directly to the other conductor of the distribution line.

7. An arrangement according to claim 1 wherein the source of alternating current comprises a power factor corrector which receives supply from a main electricity supply, and an inverter which receives power from the power factor corrector.

8. An arrangement according to claim 7 wherein the power factor corrector comprises a rectifier producing a DC output, the DC output of the power factor corrector being provided as an input to the inverter.

9. An arrangement according to claim 1 wherein a transformer is provided between the source of high frequency current and the distribution line.

10. An arrangement according to claim 1 wherein the further element formed of a material of high relative permeability extends laterally beyond the two conductors.

11. An arrangement according to claim 1 wherein the further element formed of a material of high permeability is formed of an amorphous or nano-crystalline metal.

12. An arrangement according to claim 1 wherein the insulator separating the conductors comprises a sheet of insulating material.

13. An arrangement according to claim 1 wherein the foil is separated from the face of the at least one conductor to which it is secured by means of an insulating layer.

* * * * *